United States Patent [19]

Wilkinson

[11] 4,085,525

[45] Apr. 25, 1978

[54] SHOE SUPPORT

[76] Inventor: Horace Allan Wilkinson, 13 Korocan Rd., Lilli Pilli, Sydney, New South Wales, Australia, 2229

[21] Appl. No.: 705,208

[22] Filed: Jul. 14, 1976

[30] Foreign Application Priority Data

Aug. 11, 1975 Australia ..... PC2728

[51] Int. Cl.[2] ..... A43B 21/00

[52] U.S. Cl. ..... 36/34 R

[58] Field of Search ..... 36/34 R

[56] References Cited

U.S. PATENT DOCUMENTS

| | | | |
|---|---|---|---|
| D. 186,842 | 12/1959 | Mehr | 36/34 R X |
| D. 191,433 | 10/1961 | Mehr | 36/34 R X |
| 2,713,731 | 7/1955 | Cangemi | 36/34 R |

FOREIGN PATENT DOCUMENTS

| | | | |
|---|---|---|---|
| 482,872 | 7/1953 | Italy | 36/34 R |
| 349,096 | 5/1931 | United Kingdom. | |
| 518,282 | 2/1940 | United Kingdom. | |
| 569,169 | 5/1945 | United Kingdom. | |
| 1,086,421 | 10/1967 | United Kingdom. | |
| 1,243,260 | 8/1971 | United Kingdom. | |

OTHER PUBLICATIONS

Das A.B.C., Schuh Fabrication-Aug. 5, 1938, (Seite 1074).

*Primary Examiner*—Alfred R. Guest

*Attorney, Agent, or Firm*—Beveridge, De Grandi, Kline & Lunsford

[57] ABSTRACT

A lightweight shoe heel of low visibility comprising a support member for contact with the ground and a further support member attached to the shoe, the support members being interconnected by a plurality of columns of high tensile strength material.

9 Claims, 9 Drawing Figures

SHOE SUPPORT

The present invention relates to shoe supporting devices, and provides a supporting device of novel construction which may be employed as a shoe heel, or alternatively several of which may be employed to support the entire shoe above the ground.

In providing an elevated heel construction or devices for elevating the entire shoe, three important factors must be taken into account. Firstly, the support must have sufficient strength and rigidity to carry the load imposed upon it. Secondly, the support should be as light as possible having regard to the degree of strength which is required and thirdly, the combination of strength and weight must be achieved with an appropriate degree of aesthetic appeal.

It is an object of the present invention to provide a shoe support device which is both light and strong and which has the advantage of providing a novel and attractive appearance.

According to the invention there is provided a shoe support comprising a lower support member and a plurality of columns each connected at one end to said lower support member, the other end of said columns being attached, in use, to the underside of a shoe.

Preferably, the columns are formed as rods of high tensile strength material such as high tensile steel, the rods being anchored at their ends in epoxy filled recesses or wells formed in each member.

So that the invention might be better understood, an embodiment will now be described by way of example only with reference to the accompanying drawings in which.

Figure 1:
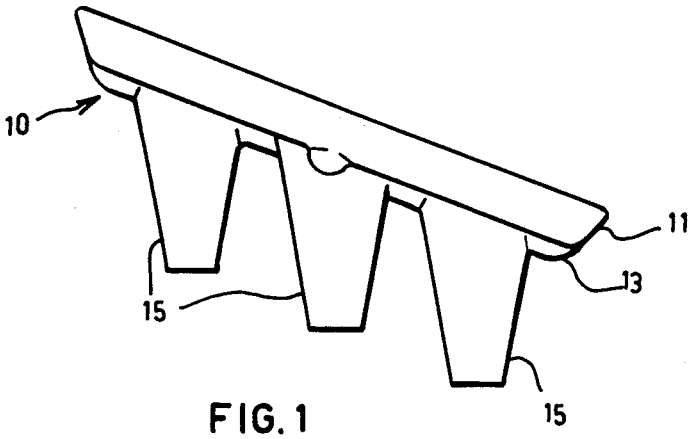
FIG. 1 shows in side elevation an upper attachment member for a heel assembly according to the invention.
Figure 2:
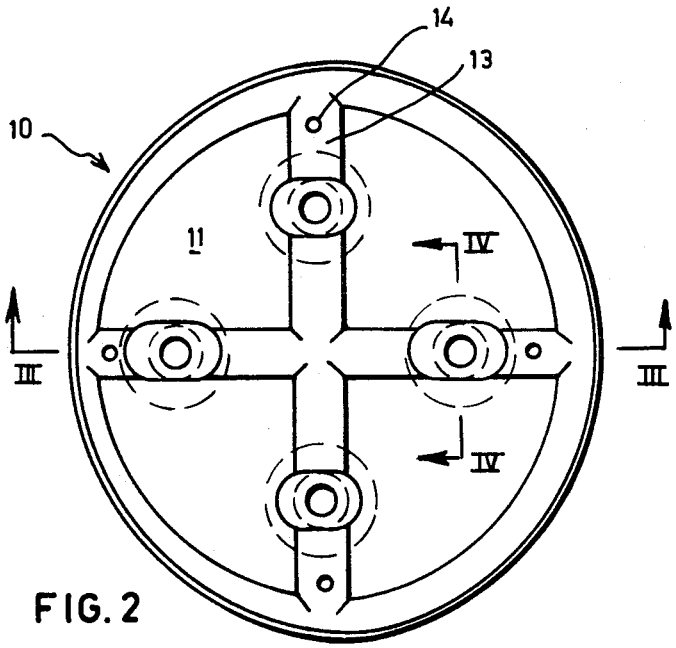
FIG. 2 shows a plan view of the upper attachment member illustrated in FIG. 1.
Figure 3:
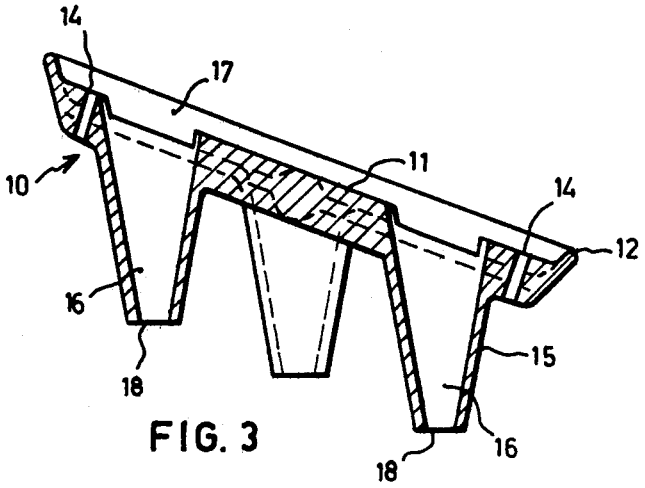
FIG. 3 shows a section taken on the lines 3—3 of FIG. 2.
Figure 4:
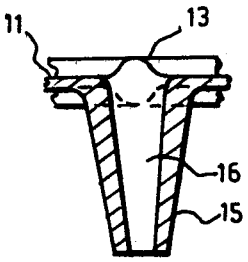
FIG. 4 shows a partial section taken on the lines 4—4 of FIG. 2.

The upper attachment member illustrated in FIGS. 1 to 4 comprises a plate 10 formed by pressure die-casting from aluminium. The plate comprises a disc shaped portion 11 which is provided with a peripheral flange 12 and four equally radially disposed stiffening ribs 13. Towards the outer end of each rib 13 is provided a hole 14 enabling the member to be attached to the heel portion of the shoe by means of nails or the like. The member may of course be attached to the shoe by a suitable adhesive such as epoxy resin.

Extending downwardly from the plate-like portion 11 of the upper member 10 are four bosses 15 having defining wells 16. The wells 16 have open upper ends 17 and open lower ends 18 of reduced diameter. These wells 16 are for the reception and anchoring of the columns which form the central part of the heel, and which will be described below. It will be noted that the bosses 15 are disposed obliquely to a direction normal to the plane of the plate portion 11, to allow the plate portion to be similarly inclined to the horizontal, the heel illustrated being designed for attachment to a shoe having a sloping heel portion. If the shoe to which the heel is to be attached has a heel portion with a horizontal lower surface, naturally the bosses 15 should have their longitudinal axes perpendicular to the plate portion 11. (Such an arrangement is described below in relation to FIGS. 6 and 7).

It will also be noted that while the external surface of each boss 15 is conical, the wall thickness is greater in a direction laterally of the shoe, so that the wells 16 are of greater width in the longitudinal direction of the shoe. This provides a degree of tolerance in the slope of the plate portion 11 and therefore in the heel portion of the shoe.

Figure 5:
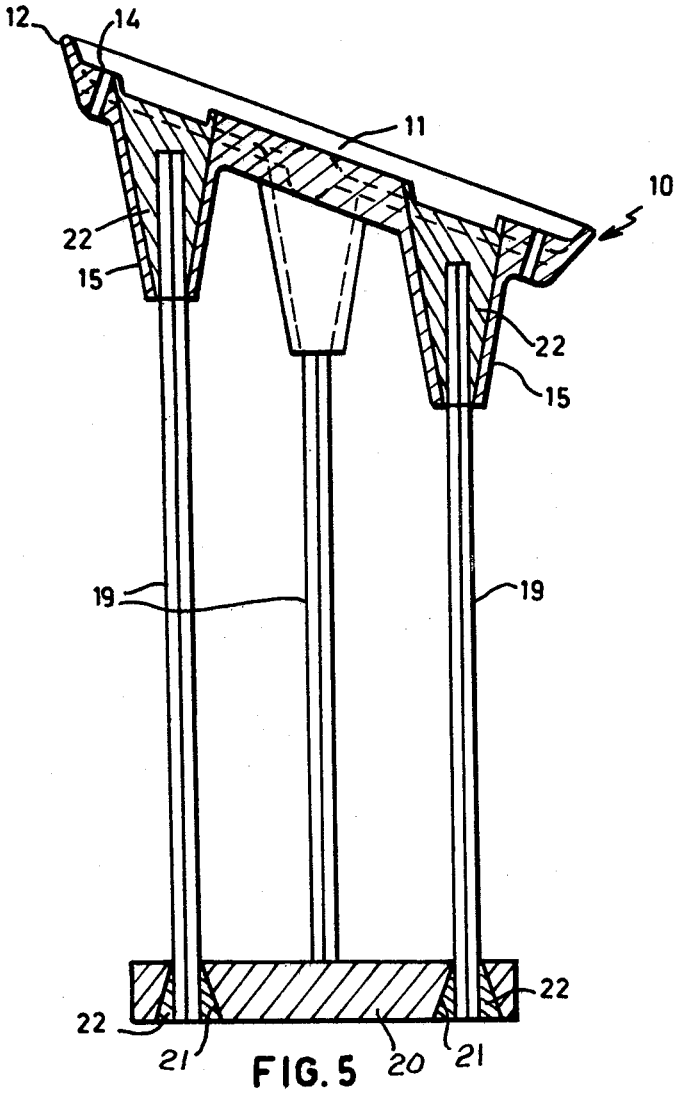
FIG. 5 shows in sectional elevation a shoe heel assembly comprising the upper support plate of FIGS. 1 and 4 with supporting columns in a lower support plate.

FIG. 5 shows a complete heel assembly, comprising the upper member 10, a set of four columns 19 each of high tensile steel, and a lower support member 20 which, like the upper member 10, is of aluminium formed by pressure die-casting.

The lower member 20 is provided with wells 21 which in this case taper outwardly towards the bottom surface of the member 20. As mentioned above, the ends of the columns 19 are fixed in the respective wells 16, 21 by means of a hardenable substance, in this case an epoxy resin mass shown at 22.

The lower surface of the member 20 may be left exposed, or a cover plate of plastic, leather or other material may be fixed by adhesive.

Since the rods 19 are of high tensile steel it is not feasible to attach them to the respective plates by techniques which involve the use of high temperatures, since this would destroy the temper of the steel. (For this purpose, a temperature of 600° C should be regarded as the acceptable upper limit). Accordingly, an attachment technique has been developed using epoxy resin which can be cured at relatively low temperatures. This method also has the advantage that lightweight aluminium can be used for at least one of the respective plates, thereby reducing the weight of the support.

In the assembly of the heel, the rods 19 are assembled in their proper relationship with either the support plate 20 or the upper member 10, by means of a jig. Epoxy resin is then poured into the wells, and the assembly passed through a continuous heating oven providing a curing temperature of about 100° C. An epoxy resin is used which cures at this temperature very quickly, and upon emerging from the oven the rods 19 are assembled with the remaining plate, epoxy resin is poured into the wells of that plate and the assembly is again passed through the curing oven.

Upon cooling of the support device after emerging for the second time from the curing oven, the metal surrounding the well contracts thereby placing the cured epoxy resin in compression and improving the strength of the joint.

This method of attaching the rods to the plates also improves the rigidity of the support device since the buckling characteristics of the rods are those of columns with built-in ends. Furthermore, since the epoxy resin isolates the steel rods from the dissimilar metal of the upper and lower members, the possibility of electrolytic corrosion at the joints is substantially eliminated.

Figure 6:
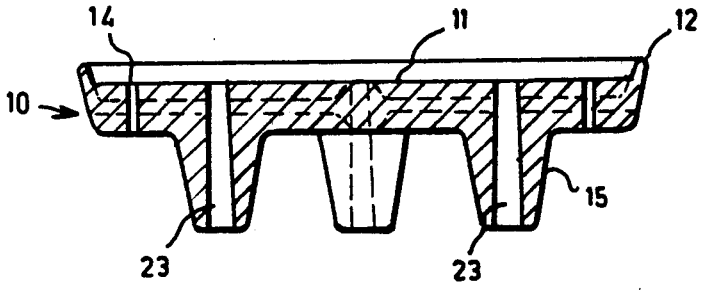
FIG. 6 shows a sectional side elevation of a modified form of upper attachment plate.
Figure 7:
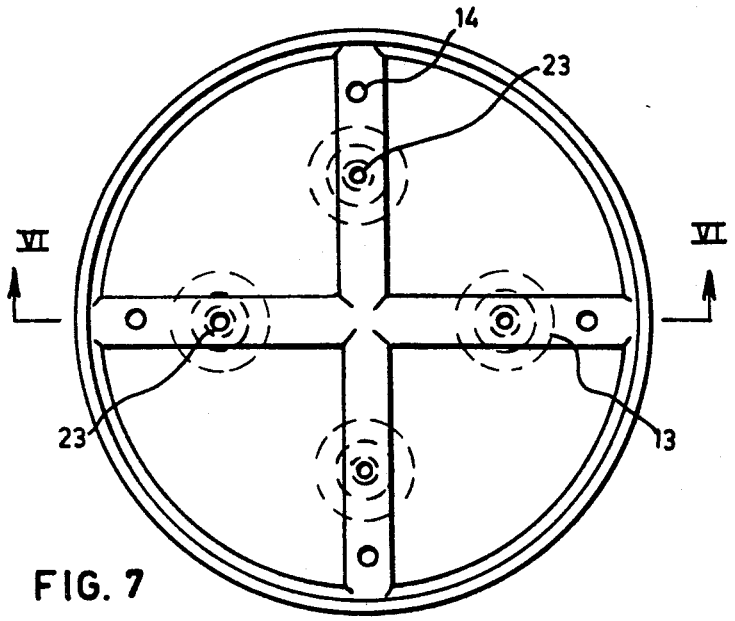
FIG. 7 shows a plan view of the attachment plate illustrated in FIG. 6.

FIGS. 6 and 7 show an alternative form of upper attachment member 10 in which it will be firstly noted that the bosses 15 extend with their longitudinal axes normal to the plate portion 11, the member 10 being intended in this case for attachment to a horizontal shoe surface. With the exception described below, the remaining features of the member shown in FIGS. 6 and 7 are the same as those of the member illustrated in FIGS. 1 to 4 and are not referred to again here.

Importantly, the member 10 of FIGS. 6 and 7 illustrates an alternative mode of attachment of the columns 19. It will be noted that in this embodiment, the wells 16 of the previously described embodiment are replaced by tapered holes 23 of circular cross-section. These holes enable the anchoring of the support columns 20 by means of a force fit. Preferably, columns of hexagonal cross-section are used, and the internal diameter of the holes 23 is chosen to be equal to the thickness of the columns across the flats of the hexagonal cross-section. A suitable press is then used for the insertion of the pins in the holes of the upper member 10, and of course into similarly dimensioned holes in the correspondingly modified lower member 20 (not shown).

As a further alternative method of fixing the columns 19, these may be provided at their ends with screw threads of opposite sense, and screwed simultaneously into threaded holes in the bosses 15 and in the lower member 20. This mode of construction is not illustrated, as its implementation will be of no difficulty to the skilled reader.

As mentioned above, the columns 19 are preferably formed of high tensile steel, and the upper and lower members of pressure die-cast aluminium. Alternatively, however, the columns may be of other materials and particularly of fibre-reinforced plastics. The upper and/or the lower support members may be of moulded plastics material, and in such a case the heel as a whole may be formed as a single or multi-part moulding from plastics material.

Again, the unit may be entirely moulded, in one or more parts, from metal, or produced by known mechanical fabrication techniques.

Figure 8:
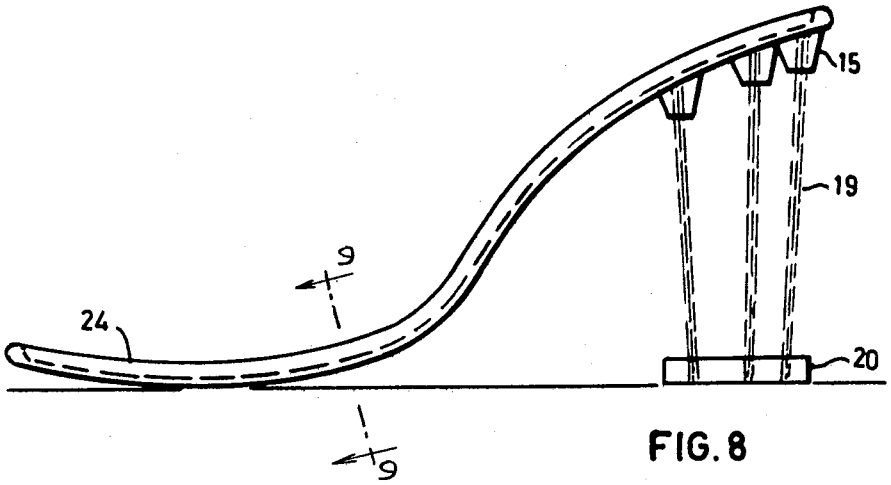
FIG. 8 shows in side elevation a modified embodiment of the invention.
Figure 9:
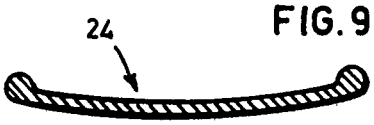
FIG. 9 shows a cross section taken on the line 9—9 of FIG. 8.

Although the embodiments of the invention described above include an upper and a lower support member, the upper member need not constitute a member separate from the shoe structure itself. Thus in cases where the shoe to which the support is to be attached has a strong sole structure, the columns may be affixed directly to the sole of the shoe. Such a construction is shown in FIGS. 8 and 9, where the shoe sole 24 is moulded in rigid plastics material, with integrally moulded bosses 25, into the wells of which the columns 19 are fixed by suitable hardening material or other suitable means.

It will be appreciated that where it is desired to increase the rigidity of the heel structure, cross-bracing may be achieved by appropriate choice of column layout, and in this case more than one column may be anchored in a given well.

From the foregoing it will be apparent that the support described gives a light and open structure which is well able to carry the required load. Moreover, the support offers a new and intriguing appearance since, when viewed at a distance, it gives the impression that the shoe is unsupported. This effect has been sought in the past through the use of glass or plastic heels, but in each case the refraction caused by these devices has destroyed the illusion which the designer has attempted to create.

It should be appreciated that the device which has been described is capable of being used alone as a shoe heel. Alternatively, a heel constructed in accordance with the present invention may be combined with several sole support devices of similar construction but of less height, to elevate the entire shoe.

I claim:

1. A shoe support comprising an upper support member; a lower support member; a plurality of column members extending between said support members, each of said column members being an elongated rod straight throughout the entire length thereof; at least one of said support members including portions defining cavities receiving the ends of said column members and having sufficient dimension to permit alignment of said column members therein over a range of angles to accommodate various heel elevations; and a hardenable adhesive material within at least some of said cavities and surrounding said column ends to anchor said column ends within said cavities.

2. A shoe support as defined in claim 1 wherein said hardenable adhesive material is a chemical cement.

3. A shoe support as defined in claim 2 wherein said chemical cement is an epoxy resin.

4. A shoe support as defined in claim 1, wherein said hardenable adhesive material is a low melting point metal.

5. A shoe support as defined in claim 4 wherein said metal is solder.

6. A shoe support as defined in claim 1 wherein each of said cavities comprises an aperture for the entry of a column, and a well containing said hardenable adhesive material, said well being of greater lateral dimension than said aperture.

7. A shoe support as defined in claim 6 wherein said cavities are of substantially conical or pyramidal configuration.

8. A shoe support as defined in claim 1 moulded from fibre reinforced plastics material.

9. A shoe support as defined in claim 1 wherein said upper support member comprises the sole structure of said shoe.

* * * * *